US006393632B1

(12) United States Patent
Epple

(10) Patent No.: US 6,393,632 B1
(45) Date of Patent: May 28, 2002

(54) END CAP COPING FOR A SWIMMING POOL

(75) Inventor: Thomas A. Epple, Fort Wayne, IN (US)

(73) Assignee: Fort Wayne Pools, Inc., Fort Wayne, IN (US)

( * ) Notice: Subject to any disclaimer, the term of this patent is extended or adjusted under 35 U.S.C. 154(b) by 0 days.

(21) Appl. No.: 09/699,706

(22) Filed: Oct. 30, 2000

(51) Int. Cl.[7] ..... E04H 4/10
(52) U.S. Cl. ..... 4/506; 4/502
(58) Field of Search ..... 4/498, 500, 502, 4/503, 506

(56) References Cited

U.S. PATENT DOCUMENTS 2,898,607 A * 8/1959 McGuire ..... 4/502
4,059,855 A * 11/1977 Riendeau ..... 4/500
4,158,244 A * 6/1979 Stefan ..... 4/503
5,107,551 A * 4/1992 Weir et al. ..... 4/506
5,134,819 A * 8/1992 Boyack ..... 4/506

* cited by examiner

*Primary Examiner*—Charles R. Eloshway
(74) *Attorney, Agent, or Firm*—Taylor & Aust, P.C.

(57) ABSTRACT

An end cap coping for a swimming pool of sufficiently low profile to allow a pool cover to be extended thereover. The end cap coping includes a body having a channel with holes in a bottom thereof for receiving fasteners extending in to a wall of the pool. An enlarged edge of the body includes a slot for retaining a bead of a liner for the pool. The end cap coping is positioned above a target water level for the pool, but below tracks supporting a cover of the pool. A cover is provided for the channel.

11 Claims, 4 Drawing Sheets

END CAP COPING FOR A SWIMMING POOL

BACKGROUND OF THE INVENTION

1. Field of the Invention

The present invention relates to copings for a swimming pool, and, more particularly, relates to coping end caps for a swimming pool.

2. Description of the Related Art

A swimming pool may include a plurality of upright perimeter walls surrounding the pool, adjacent the deck area of the pool. The walls may be metal, plastic or concrete. When plastic or metal walls are used, it is common to lay a vinyl liner along the walls and across the bottom. A target water level is defined, being generally the level at which skimmers and return water lines are provided in the pool walls. The actual water level may, however, vary from the target water level.

A coping is disposed about the periphery of the pool and above water level. It is common for a coping to interconnect the sidewalls, pool liner and walkway or deck area of the pool. For example, a coping may include a bottom surface which is adapted for connection to a sidewall of the pool using appropriate fasteners, and a facia having a slot extending the longitudinal length thereof which receives a bead disposed at the top edge of the liner. The back of the coping, disposed opposite the facia, is adapted to receive and interconnect with concrete forming the walkway.

It is known to provide extruded copings which are formed from metal, e.g., aluminum. Compared to plastic copings, metal copings provide the advantages of increased ability to withstand thermal expansion and contraction, resistance to UV radiation, and relatively high strength and rigidity. Conventional metal swimming pool copings may include a curved facia with a liner bead slot, and may further include a light receiving slot therein for receiving a fiber optic or light emitting diode light source, providing aesthetic appeal.

Swimming pools are commonly covered to prevent debris from entering the pool, and to heat the pool in the case of a solar cover. A pool cover also provides a degree of safety, and reduces chemical usage. An automatic pool cover provides convenience for a user by allowing the cover to be easily extended over the pool during periods of non-use, and retracted during periods of use. Typically, the automatic pool cover is wound around a reel retained within a cover box at an end of the pool, commonly the deep end, opposite from the walk-in steps at the shallow end of the pool. A pair of tracks extend along each side wall of the pool, and can either be mounted to the concrete deck (i.e., deck mounted) or incorporated into the coping (i.e., under-rail mounted) which surrounds the pool. Regardless of whether the track is deck mounted our integral with the coping, the track is always positioned above the target water level in the pool. The cover includes a cable, rope or the like sewn into or otherwise attached to the side edges of the cover material, and retained in the tracks. An electric motor coupled with the reel and ropes selectively moves the cover to a closed or an opened position. When in an extended, or closed, position over the pool, the automatic pool cover hangs from the track and slopes away from the track toward the middle of the pool. The center portion of the cover rests on and is supported by the water in the pool.

The leading edge of the cover should be maintained at a position above the pool water surface as the cover is moved between closed and opened positions. It is known to fasten a leading edge bar to the leading edge of the cover for this purpose. The leading edge bar extends across the width of the pool and may be attached to loops or the like sewn into the leading edge of the cover.

In the design of some pools, the shallow end includes walk-in steps whereby a person may enter the pool. One or more of the steps may be above the target water level, and may extend across the full width of the pool, or may be a more limited entrance, narrower than the pool width. The first step into the pool may take the form of a small platform, several feet wide and as long as the width of the pool. It may be only several inches below the top edge of the pool, less than a conventional step, and is not normally covered by the liner material, which is typically retained at an end coping at the waterside edge of the entrance platform. When an under-rail mounted automatic cover is used, copings of previous designs have prevented the leading edge of the cover from passing thereover, and closing of the cover normally terminates at the coping, leaving the entrance platform uncovered.

While covering a pool in the manner just described accomplishes many of the goals for covering a pool, such as heat retention, chemical conservation and security, when the platform is uncovered, it may leave a visual impression that the pool is not fully covered and the cover not fully extended. Further, while the water area is protected from dirt and debris, the entrance platform is not. Whereas the deck area adjacent the pool may slope away from the pool and is easily cleaned without substantial contamination of the pool water, the same is not true for the entrance platform. The surface of the platform is commonly below the deck and cleaning the entrance platform can result in the dirt and debris thereon being washed into the pool water, where it must be removed by skimmers or other pool water cleaning apparatus.

What is needed in the art is a pool edge coping system which allows a pool to be fully covered, including any entrance platform disposed lower than the pool deck.

SUMMARY OF THE INVENTION

The present invention provides a swimming pool including an end cap coping having a low profile, which allows an automatic or manually operated cover to pass thereover and a pool cover which can be extended sufficiently to cover the pool water and any entrance platform lower than the pool deck.

The invention comprises, in one form thereof, a coping for use in a swimming pool, the coping having a longitudinal direction. The coping includes a base having means for connecting to a wall of the pool, an enlarged edge on the base with a slot for receiving and retaining a liner bead therein. The coping is of limited vertical profile.

The invention comprises, in another form thereof, a swimming pool with a plurality of walls including a pair of side walls on opposite sides of the pool and an end wall disposed between the pair of side walls. The plurality of walls define a target water level. A liner extends along the walls. A pair of side copings are associated with the respective side walls and are positioned above the target water level. Each side coping includes means for retaining edges of the liner. A track is associated with each side wall, and a cover includes a pair of longitudinal side edges, the side edges being carried by a corresponding track of the side wall. An end coping is associated with the end wall. The end coping includes means for retaining an end edge of the liner. The end coping is of sufficiently low profile to be above the target water level and below the tracks.

In still another form thereof, the invention comprises an end cap coping for the top of a swimming pool end wall, the end cap coping comprising a base portion extending in a longitudinal direction, the base portion including a channel having a plurality of holes therein for receiving fasteners securable in the end wall. A plurality of supports depend downwardly from the base portion and rest against the end wall top. An enlarged edge extends along the base portion, and includes a nose piece and a base connected by one of the supports. The nose piece and the base define a liner bead slot having an opening thereto.

An advantage of the present invention is that the end coping of the present invention allows pool covers to be passed thereover without interference from the end coping.

Another advantage of the present invention is that an automated pool cover can be passed over an end wall of a pool having an end cap coping of the present invention thereby allowing the cover to protect an entrance platform at an end of the pool below the deck surrounding the pool. Still another advantage of the present invention is providing an end cap coping easily manufactured by extrusion processes.

A further advantage of the present invention is providing an end cap coping having a smooth surface, with means covering fasteners used for attaching the coping to a pool wall.

BRIEF DESCRIPTION OF THE DRAWINGS

The above-mentioned and other features and advantages of this invention, and the manner of attaining them, will become more apparent, and the invention will be better understood, by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
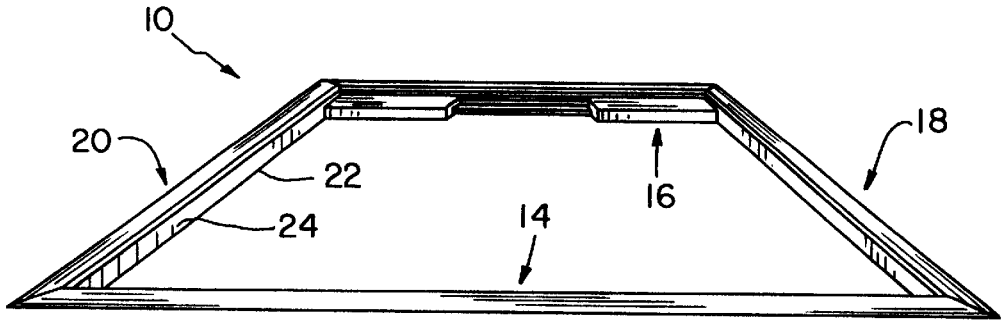
FIG. 1 is a perspective view of a swimming pool in which the present invention may be used advantageously.
Figure 2:
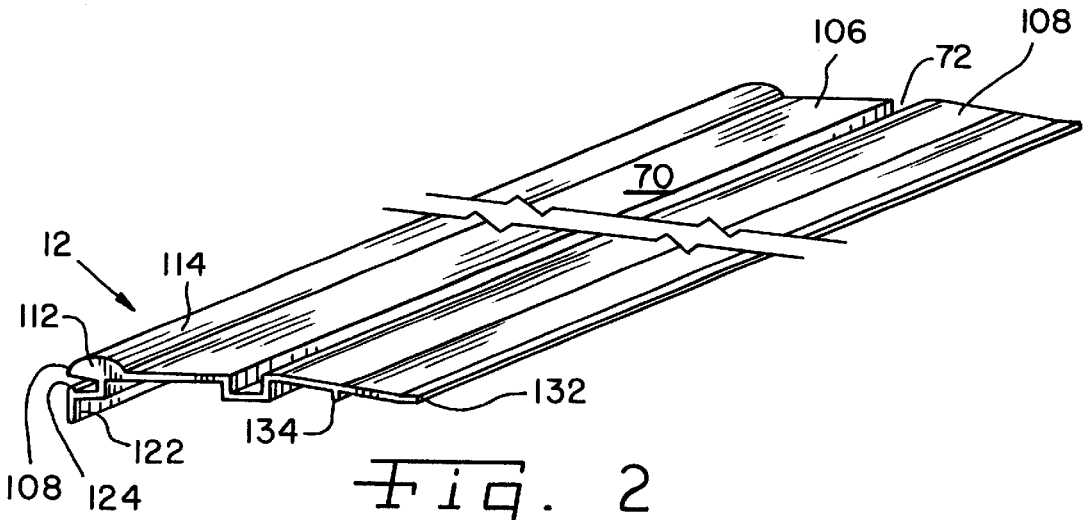
FIG. 2 is a perspective view of an end cap coping of the present invention.
Figure 3:
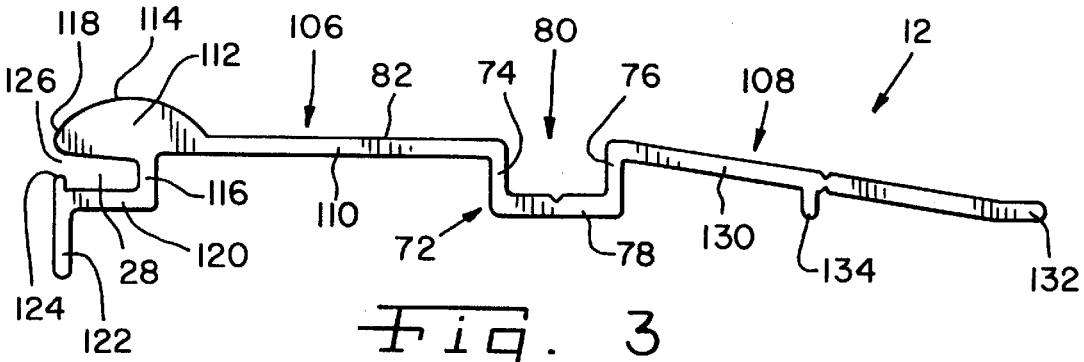
FIG. 3 is an elevational of an end of the coping shown in FIG. 2.

Referring now to the drawings, and more particularly to FIG. 1, there is shown an embodiment of a swimming pool 10, which includes an end cap coping 12 of the present invention, shown more clearly in FIG. 2. It should be understood that pool 10 is only an example of a pool structure in which the present invention may be used advantageously, and that an end cap coping according to the present invention may be used advantageously on other types, structures and styles of swimming pools.

Swimming pool 10 includes a plurality of walls 14, 16, 18, 20; including a pair of opposite end walls 14, 16 and a pair of opposite side walls 18, 20. Each of end walls 14 and 16 can advantageously use end cap coping 12. End walls 14, 16 and side walls 18, 20 form an enclosed region for containing water of pool 10, and define a target water level 22 within swimming pool 10. To wit, end walls 14, 16 and/or side walls 18, 20 typically include one or more skimmers (not shown) and one or more water returns (not shown). It is usually desirable to fill swimming pool 10 to a specified degree for proper operation of the skimmers, etc. Of course, the actual water level may vary somewhat from target water level 22 and still provide effective operation of swimming pool 10.

Figure 6:
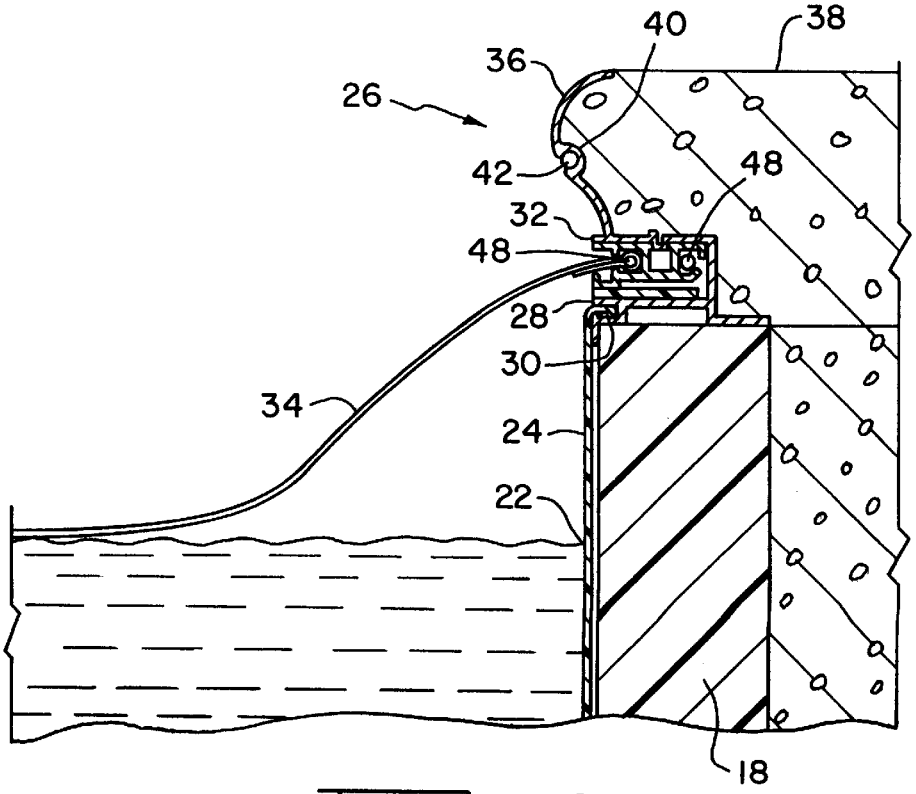
FIG. 6 is a cross-sectional view of a side wall of the pool shown in FIG. 5, taken along line 6—6 of FIG. 5.

End walls 14 and 16 and side walls 18 and 20 are constructed of metal, plastic, or the like. A vinyl liner 24 is provided as a watertight barrier along end walls 14, 16 and side walls 18, 20 and across the bottom of the pool. Each of side walls 18, 20 includes a side coping 26, which is fastened to side walls 18, 20. A single side coping 26 is illustrated in FIG. 6, for side wall 18. Opposite side wall 20 likewise includes a substantially identically configured side coping 26. A liner bead slot 28 is provided in each side coping 26, for carrying an edge bead 30 of vinyl liner 24, for holding liner 24 in proper position. Side coping 26 further includes a track 32, above target water level 22, for carrying a cover 34, as will be described in greater detail hereinafter. Side coping 26 defines a facia 36 extending along the top, side edges of swimming pool 10, and serves to join a top deck area 38, immediately outside of pool 10, to sidewall 18. Deck 38 is commonly an are of poured concrete surrounding pool 10. A light receiving slot 40 and a fiber optic tube light 42 may be used with side coping 26, for aesthetic appearance. Individual lengths of side coping 26 are coupled in an end-to-end manner so that side coping 26 extends from one end of pool 10 to the other end of pool 10. Side coping 26 may be made of plastic, but preferably is of metal such as aluminum, and is formed by a process of extrusion.

Figure 5:
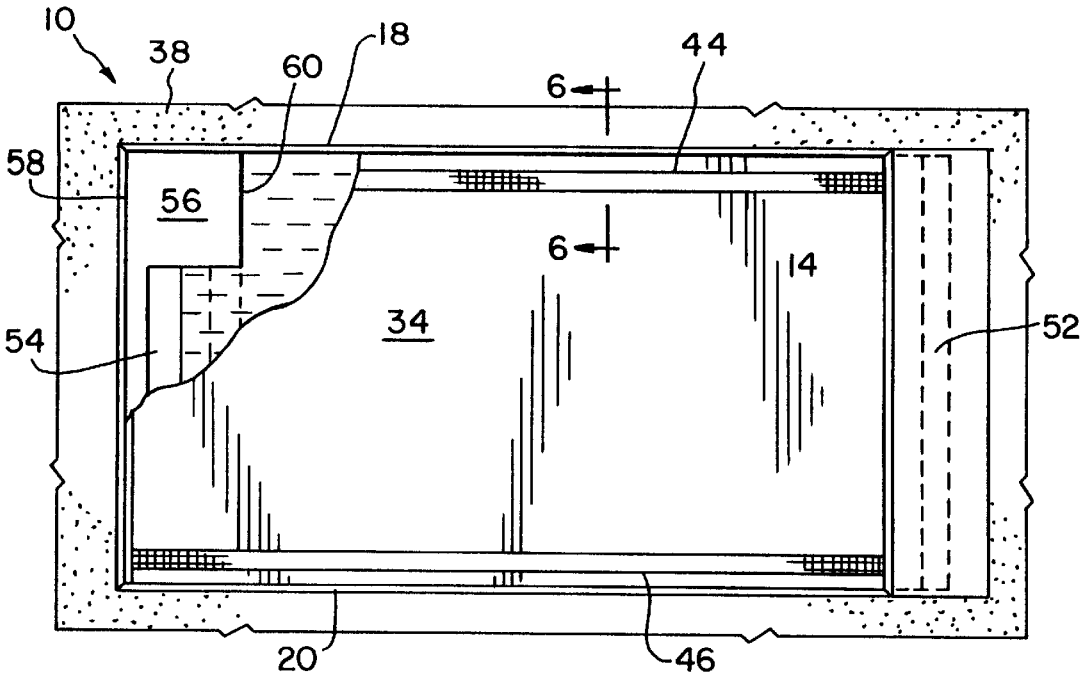
FIG. 5 is a perspective view, partially broken away, of a swimming pool having a cover fully extended thereover.

Cover 34 includes a pair of longitudinal side edges 44, 46 (FIG. 5). Each side edge 44, 46 is carried by a corresponding track 32 along respective side walls 18, 20 (FIG. 6). A rope carrier 48 is sewn into cover 34 along each side edge 44, 46. Rope carrier 48 is received within a corresponding track 32 for allowing cover 34 to be extended and retracted over pool 10. The term "rope carrier", as used herein, is intended to mean any elongate element which may be coupled with a corresponding side edge 44, 46 and carried within a corresponding track 32, such as, for example, nylon, hemp or steel rope.

Figure 7:
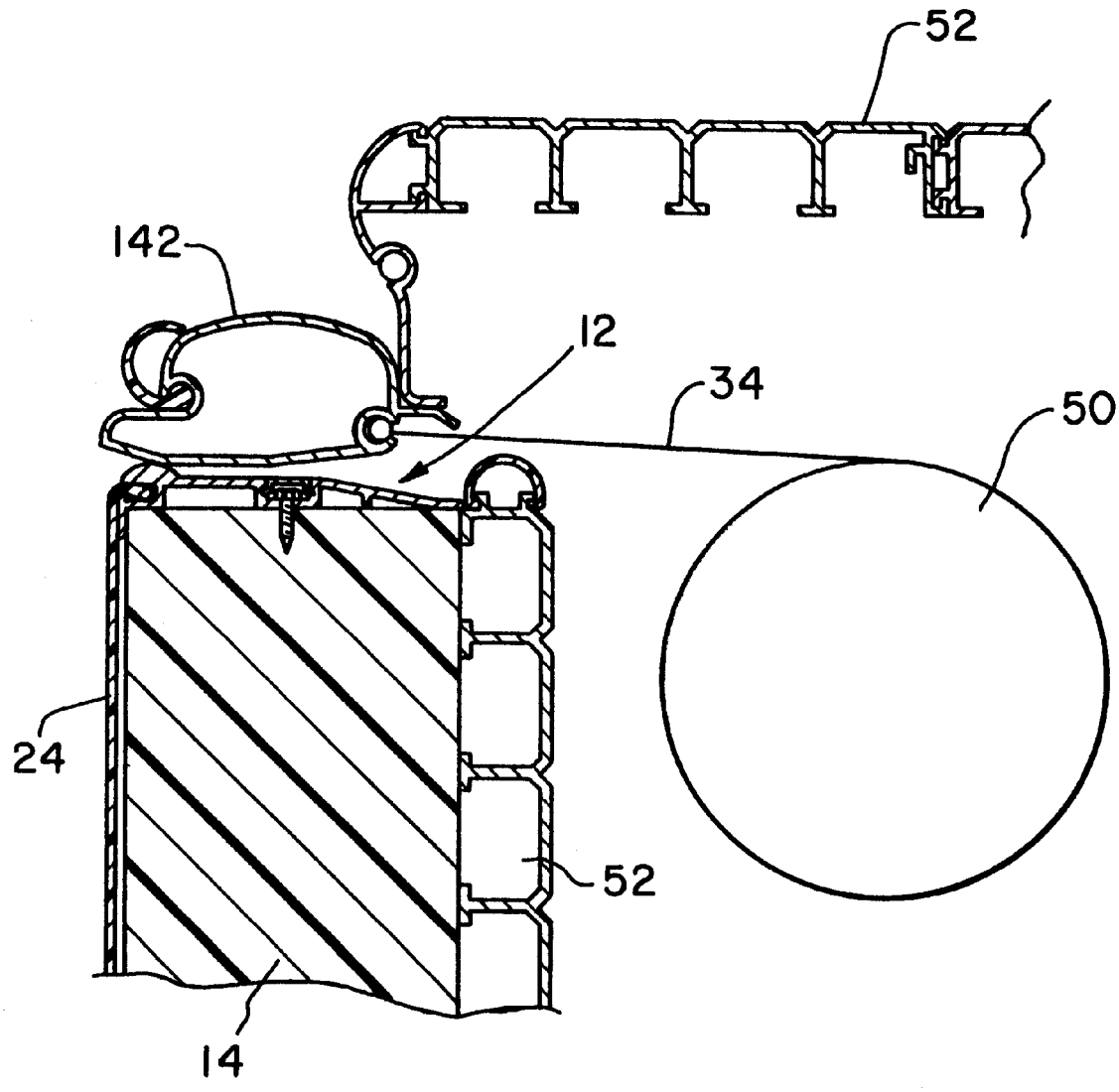
FIG. 7 is a cross-sectional view showing an end cap coping of the present invention on an end wall of a pool adjacent a cover box for an automatic pool cover.

Cover 34 is an automatic cover, having drive means (not shown) for extending and retracting cover 34 over the water in pool 10. Cover 34 is stored on a reel 50 in a cover box 52 disposed at one end of pool 10. In FIGS. 6 and 7, cover box 52 is shown positioned immediately outwardly of end wall 14, and may be constructed of treated lumber or may be a modular structure of extruded thermoplastic, aluminum, or the like. At the opposite end of pool 10, at end wall 16 as shown best in FIG. 5, a walk-in stairway 54 is provided, leading from an entrance platform 56 into pool 10. Entrance platform 56 extends across the width of pool 10, and is positioned slightly lower than deck 38 surrounding pool 10. In the embodiment shown, platform 56 is several feet wide and extends across the width of pool 10, from a deck-side edge 58 to a water-side edge 60 thereof.

Liner 24 extends lengthwise in pool 10 from end wall 14 to water-side edge 60 of entrance platform 56, being secured in end coping 12 as will be described in more detail hereinafter. Liner 24 extends across pool 10 from side coping 26 on side wall 18 to side coping 26 on side wall 20, being secured in liner bead slots 28 thereof. While liner 24 ends at edge 60, in accordance with the present invention, side copings 26 of side walls 18, 20 extend beyond edge 60, substantially the full width of entrance platform 56 to deck-side edge 58 thereof.

End cap coping 12 provides a top for end walls 14,16, and secures liner 24 in place, while allowing cover 34 to be extended thereover. End cap coping 12, therefore, is of minimal vertical profile, such that, in a preferred arrangement thereof, end cap coping 12 is entirely lower than tracks 32 of side copings 26. End cap coping 12 is an elongated body 70, relatively narrow compared to its length, extending in a longitudinal direction along the perimeter of pool 10. Body 70 may be formed of extruded plastic, metal such as aluminum, or the like, and is generally adapted to sit on top of an end wall 14, 16 and be secured thereto. The embodiment to be described is particularly suitable to be of a metal construction formed by a process of extrusion, and may be relatively easily fabricated. It is to be understood, however, that end cap coping 12 could be formed by other processes, such as molding. In a typical installation and use of end cap coping 12, a plurality of individual lengths thereof are secured in end-to-end relationship on end wall 14, 16 to extend across the width of pool 10.

Figure 4:
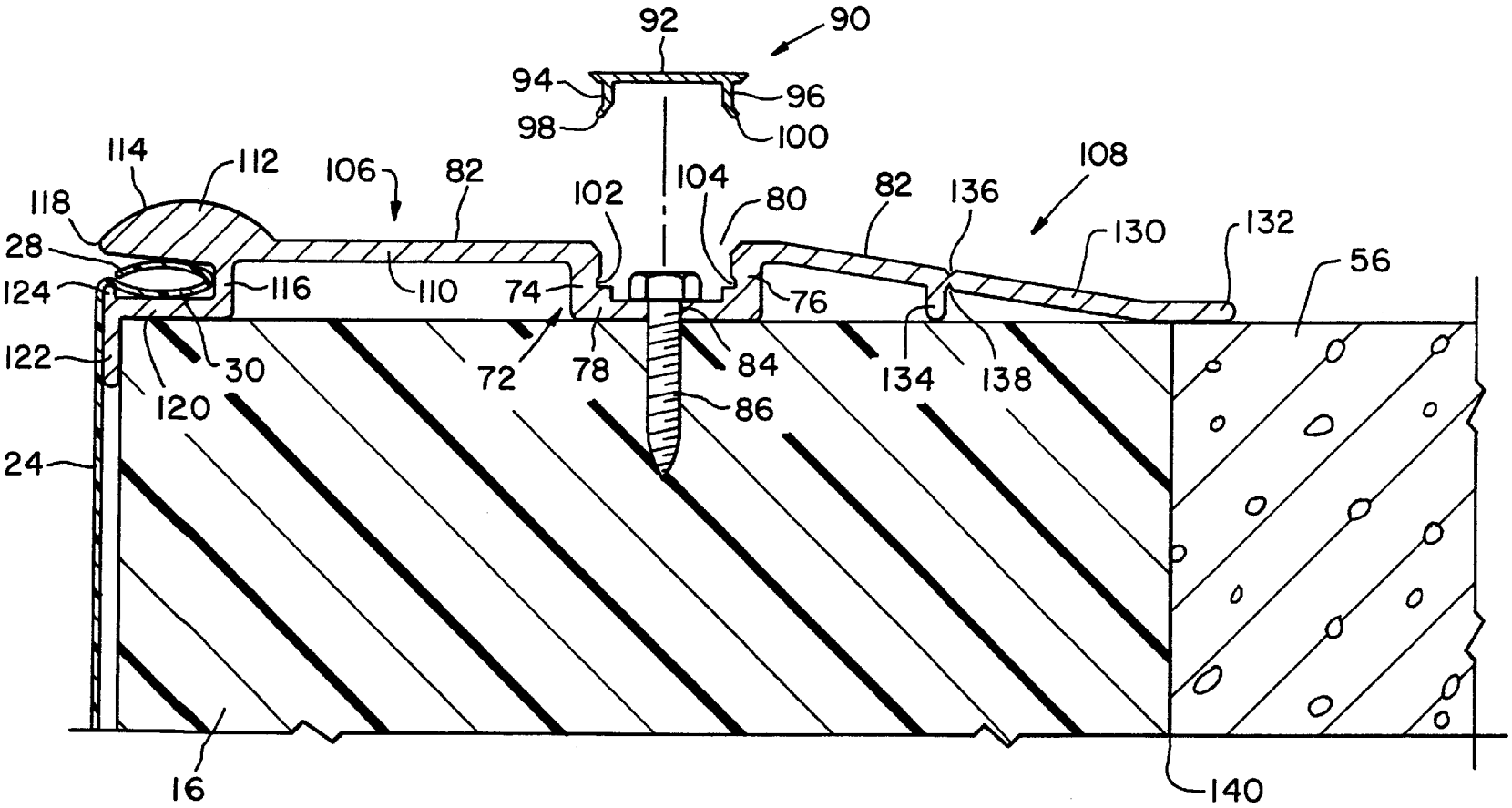
FIG. 4 is a cross sectional view showing an end cap coping of the present invention installed on a swimming pool end wall.

An end cap coping 12 properly installed on end wall 16 is shown in FIG. 4. A plurality of individual lengths of end cap coping 12 may be secured in end-to-end relationship, to extend the full width of pool 10. For securing end cap coping 12 to end wall 16, a channel 72 is provided, and extends the length of end cap coping 12. Channel 72 includes sides 74, 76 and a bottom 78 which rests on the top of end wall 16, thereby forming a support of end cap coping 12. Channel 72 has an opening 80 thereto, accessible from a top surface 82 of end cap coping 12. At spaced locations along channel 72, a hole or opening 84 is provided in bottom 78, through which a fastener 86 may be inserted from channel 72 into end wall 16. As shown in FIG. 4) fastener 86 is a threaded fastener such as a self tapping screw, compatible with the material of end wall 16, for anchoring end cap coping 12 to end wall 16. Securement of an end cap coping 12 to end wall 14 is performed similarly to that shown in FIG. 4 with respect to end wall 16.

To establish a smooth, continuous top surface 82, a cover 90 is provided for channel 72. Cover 90 includes a top 92 and legs 94, 96, and is shaped to seat in channel 72, closing opening 80 thereof. In a preferred embodiment of cover 90, legs 94, 96 depend downwardly from top 92 and include outwardly curved end tips 98, 100. Sides 74, 76 of channel 72 include grooves 102, 104, respectively, for receiving tips 98, 100 therein. Thus, cover 90 can be secured in channel 72, covering and protecting fasteners 86 and providing a smooth, continuous extension of top surface 82 on either side if top 92.

End cap coping 12 further includes an inside base portion 106 on the pool side of channel 72 and an outside base portion 108 on the deck side of channel 72. Inside base portion 106 includes a plate 110 extending laterally from channel 72, generally at right angles to side 74 thereof. Plate 110 has an enlarged edge, including a nose piece 112 at the inner most edge of end cap coping 12. Nose piece 112 has a generally arched or rounded upper surface 114 across which cover 34 may slide without snagging. A support 116 depends downwardly from plate 110, generally under nose piece 112, but recessed inwardly from an innermost edge 118 of nose piece 112. Support 116 connects to a base 120 having a flange 122. Base 120 is spaced from nose piece 112, thereby defining a liner bead slot 28 between base 120 and nose piece 112. Base 120 rests on the top of end wall 16, and flange 122 extends downwardly from base 120, generally at the top, inner edge surface of end wall 16. A lip 124 of flange 122 extends upwardly from base 120, to define a restricted opening 126 of liner bead slot 28 in end cap coping 12.

Outside base portion 108 has a plate 130 extending laterally from channel 72, and angles downwardly from side 76 thereof. Plate 130 includes a tail 132 which may flatten against the top of wall 16 and entrance platform 56. An intermediate support 134 extends downwardly from plate 130 and rests against the top of end wall 16, thereby providing stabilization of plate 130 between channel 72 and tail 132. To allow tail 132 to flatten properly against the top of end wall 16 and entrance platform 56, upper and lower score marks 136 and 138, respectively, are provided in plate 130, just outwardly of intermediate support 134. In a preferred arrangement, end cap coping 12 is slightly wider than end wall 16, such that tail 132 extends past end wall 16 and covers a seam 140 between end wall 16 and entrance platform 56.

In FIG. 7, an end cap coping 12 installed on end wall 14 is shown. It can be seen that the low profile of end cap coping 12 allows cover 34, and a leading edge bar 142 thereof to pass over end cap coping 12 as cover 34 is unrolled from reel 50 and extended over pool 10. Securing an edge of liner 24, end cap coping 12 is disposed above target water level 22. Being of minimal vertical profile, end cap coping 12 is disposed below tracks 32 of side copings 26.

As illustrated in FIG. 5, end cap coping 12 installed on end wall 16 is also below tracks 32 of side copings 26, thereby allowing cover 34 to be drawn thereover for covering entrance platform 56. Relatively rigid leading edge bar 142 extends substantially linearly between side wall 18 and side wall 20, and will therefore pass over end cap coping 12. Even if the material of cover 34 sags behind leading edge bar 142, cover 34 will slide easily over upper surface 114 of nose piece 112 at either end wall 14 or end wall 16.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A swimming pool, comprising:

a plurality of walls including a pair of side walls on opposite sides of said pool and an end wall disposed between said pair of side walls, inner surfaces of said plurality of walls defining a target water level;

a liner extending along said walls, said liner having a plurality of edges;

a pair of side copings, each said side coping associated with a respective said side wall and positioned above said target water level, each said side coping including means for retaining an edge of said liner;

a track positioned adjacent to each side wall inner surface;

a cover including a pair of longitudinal side edges, each said side edge of said cover carried by a corresponding said track for movement generally along said sidewall inner surfaces; and an end coping associated with said end wall, said end coping including means for retaining an edge of said liner, said end coping being of sufficiently low profile to be above said target water level and below said tracks and thereby allow said cover to slide thereover.

2. The swimming pool of claim 1, wherein said plurality of walls includes two end walls disposed between said side walls, each of said end walls having an end coping associated therewith, each said end coping being of sufficiently low profile to be above said target water level and below said tracks.

3. The swimming pool of claim 2, wherein an entrance platform is disposed at an end of said pool outwardly of one said end wall, and said tracks extend outwardly of said one said end wall substantially along said platform.

4. The swimming pool of claim 3, wherein a reel box is disposed outwardly of the other said end wall.

5. The swimming pool of claim 1, wherein an entrance platform is disposed at an end of said pool outwardly of said end wall, and said tracks extend beyond said end wall substantially along a width of said platform.

6. The swimming pool of claim 1, wherein said end coping includes an enlarged edge having a slot therein for receiving a bead on an edge of said liner.

7. The swimming pool of claim 1, wherein said end coping includes a channel and means in said channel for attaching said end coping to said end wall.

8. The swimming pool of claim 7, wherein a cover is provided for said channel, including means for securing said cover to said channel.

9. The swimming pool of claim 7, wherein said means in said channel includes a plurality of holes in said channel and fasteners for extending through said holes into said end wall.

10. The swimming pool of claim 9, wherein a cover is provide for said channel, including means for securing said cover to said channel.

11. The swimming pool of claim 1, wherein said end coping includes a nose piece having a curved upper surface.

* * * * *